United States Patent [19]

Zafiroglu

[11] Patent Number: 4,998,421

[45] Date of Patent: Mar. 12, 1991

[54] PROCESS FOR ELASTIC STITCHBONDED FABRIC

[75] Inventor: Dimitri P. Zafiroglu, Greenville, Del.

[73] Assignee: E. I. Du Pont de Nemours and Company, Wilmington, Del.

[21] Appl. No.: 545,047

[22] Filed: Jun. 28, 1990

[51] Int. Cl.[5] ..... D04B 23/08

[52] U.S. Cl. ..... 66/192; 66/196; 66/202; 428/102

[58] Field of Search ..... 66/192, 196, , 202; 428/102

[56] References Cited

U.S. PATENT DOCUMENTS

| | | | |
|---|---|---|---|
| 4,704,321 | 11/1987 | Zafiroglu | 428/230 |
| 4,773,238 | 9/1988 | Zafiroglu | 66/192 |
| 4,876,128 | 10/1989 | Zafiroglu | 428/102 |

*Primary Examiner*—James J. Bell

[57] ABSTRACT

An improved process is provided for making stitchbonded elastic fabrics more economically. The improvements involve stitching with an elastic thread having a high residual stretch, overfeeding fibrous web to the stitchbonding machine and removing the resultant product under low tension.

6 Claims, No Drawings

PROCESS FOR ELASTIC STITCHBONDED FABRIC

BACKGROUND OF THE INVENTION

1. Field of the Invention

The present invention relates to a process for making an elastic stitchbonded fabric by multi-needle stitching a nonbonded or lightly bonded fibrous layer with elastic yarns. More particularly, the invention concerns an improvement in such a process wherein the elastic stitching yarns enter the needles with high residual stretch. The process provides more economical, stretchable fabrics, particularly suited for use in elasticized portions of diapers, cuffs, waistbands, bandages, and the like.

2. Description of the Prior Art

Processes are known for making stretchable stitchbonded nonwoven fabrics by multi-needle stitching of a fibrous layer with elastic yarn. Several of my earlier patents disclose such processes. For example, U.S. Pat. No. 4,704,321 describes such stitching of a plexifilamentary polyethylene sheet (e.g., Tyvek®); U.S. Pat. No. 4,876,128 discloses such stitching of other fibrous layers; and U.S. Pat. No. 4,773,238 describes such stitching of a substantially nonbonded web and then contracting the stitched fabric to less than half its original area.

To produce a highly stretchable stitchbonded fabric by a process of my earlier patents generally required that the stitched fabric be allowed to contract extensively immediately after the stitching step. The contraction was caused by the retractive power of the elastic stitching yarns. Although my earlier processes produced stitchbonded fabrics suitable for a variety of uses, reductions in fabric cost were desired. The cost per unit area of elastic fabrics produced by my earlier processes were in direct proportion to the area contraction the fabric experienced immediately after stitching. Thus fabrics with high post-stitching contraction had high costs per unit area.

In the past, stitchbonding with elastic yarns usually was not performed with accurately controlled tensions on (a) fibrous layers fed to the stitchbonding machine, (b) elastic yarns fed to the stitching needles and (c) stitched fabrics leaving the machine. Generally, the stitchbonding machines were operated with high tensions on each of these components. In addition, the elastic yarns were subjected to increase tension by the action of the stitching needles of the stitchbonding machine. Accordingly, the yarns arrived at the stitching needles with high elongations and were inserted into the fibrous layer very little residual stretch remaining in the yarns. The elongation of the stitched yarn usually was quite close to its break elongation. For example, in accordance with the processes described in my U.S. Pat. No. 4,773,238, the elastic yarns were fed to the stitchbonding machine with an elongation of 100 to 250%, and then further stretched by the action of the stitching needles. The high elongation and low residual stretch of the elastic yarns in the stitched fabric were evident from the large contraction the stitchbonded fabric experienced as it left the stitching machine, even though a high wind-up tension was applied to the exiting fabric, and from the inability of the resultant fabrics to be stretched much beyond its original stitched dimensions. In Example 2 of the patent, a maximum extension to 20% beyond the original length of the fibrous layer was disclosed; all other examples disclosed fabrics that could not be stretched beyond their original stitched length. The high tensions and retractive forces in the stitching yarns of the earlier processes resulted in contractions of the stitched fabric to less than 40% and sometimes to than less than 20% of their original stitched dimensions. It was only after the contraction that the fabrics could be stretched significantly.

An object of the present invention is to provide an improved process for making an elastic stitchbonded fabric which does not require a large contraction of the fabric immediately after stitching in order to achieve elastic stretchability.

SUMMARY OF THE INVENTION

The present invention provides an improved process for preparing an elastic stitchbonded fabric. The process is of the type which comprises the known steps of (a) feeding nonbonded or lightly bonded fibrous layer weighing in the range of 15 to 150 g/m$^2$, preferably 20 to 50 g/m$^2$, to a multi-needle stitching machine, (b) stitching the fibrous layer with an elastic thread that forms spaced-apart, parallel rows of stitches in the layer, the needle spacing being in the range of 0.5 to 10 needles per centimeter, preferably in the range of 2 to 8 needles per cm, and the stitches within each row being inserted at a spacing in the range of 1 to 7 stitches per centimeter, preferably 2 to 5 stitches per cm, and (c) withdrawing the stitched layer from the machine. The improvement of the present invention comprises feeding the elastic yarns to the stitching needles with a residual stretch of at least 100%, preferably at least 150%, most preferably 200%. The resultant stitchbonded fabric preferably is withdrawn from the machine under a tension of less than 5 pounds per linear inch of fabric width (9 Newtons per centimeter), most preferably less than 2 lb/in (3.5 N/cm). Also preferred is that the fibrous layer be overfed, usually in an amount in the range of 2.5 to 50%, most preferably 10 to 35%.

The invention also includes stitchbonded fabric produced by the process described in the preceding paragraph. Such fabrics of the process can be stretched in at least one direction to at least twice, preferably three times, its originally stitched dimension and subsequently elastically recover substantially completely from the stretch. Thus, the fabrics of the process of the invention have an elastic stretch, in at least one direction, of at least 100%, preferably at least 200%.

DETAILED DESCRIPTION OF PREFERRED EMBODIMENTS

The process of invention will now be described in detail with regard to a preferred embodiments.

As used herein, the term "substantially nonbonded", with regard to the fibrous layer that is to be multi-needle stitched, means that the fibers or filaments of the layer generally are not bonded to each other, as for example by chemical or thermal action. However, a small amount of overall bonding, point bonding or line bonding is intended to be included in the term "substantially nonbonded", as long as the bonding is not sufficient to prevent (a) satisfactory feeding of the fibrous layer to the multi-needle stitching operation and/or (b) elastic stretching of the fabric after the stitching.

The term "fiber", as used herein, includes staple fibers and/or continuous filaments and/or plexifilaments.

"MD" refers to the machine direction of the stitchbonded fabric or a direction that is parallel to the rows of stitches. "TD" refers to the fabric direction that is transverse to the machine direction or a direction that is perpendicular to the MD rows of stitches.

The starting fibrous layer that is to be stitchbonded with elastic yarns in accordance with the process of the present invention can be selected from a wide variety of non-bonded or lightly bonded nonwoven layers of natural or synthetic organic fibers. Among the various fibrous layer starting materials are carded webs, cross-lapped webs, air-laid webs, water-laid webs, continuous-filament sheets, spunlaced fabrics and the like. The fibrous layer usually weighs in the range of 15 to 150 $g/m^2$, preferably in the range of 20 to 50 $g/m^2$. The lighter weight fibrous layers are usually used with the lightly bonded materials and the heavier weights with the non-bonded layers. Among the continuous filament sheets suitable for fibrous starting layers in accordance with the invention are Tyvek® spunbonded polyolefin (sold by E. I. du Pont de Nemours and Company), Typar® spunbonded polypropylene and Reemay® spunbonded polyester (both made by Reemay, Inc., of Old Hickory, Tenn.). A suitable spunlaced fabric made of hydraulically entangled, preferably lightly entangled, staple fibers is Sontara® (made by E. I. du Pont de Nemours and Company).

Generally, the fibrous starting layer itself is capable of being elongated in the direction desired for the final stitchbonded product of the process to at least 1.5 times, preferably two times, its original linear dimension without breaking or forming holes in the layer. Generally, for use in the process of the present invention, carded webs are preferred for making TD-stretchable stitchbonded fabrics. Cross-lapped carded webs that are lapped at sharp angles to each other are are suitable for fabrics that are to be highly MD-stretchable. Lightly bonded sheets of randomly arranged continuous filaments are suitable for making MD-and/or TD-stretchable fabrics. Lightly entangled spunlaced fabrics are preferred for making TD-stretchable stitchbonded fabrics. One or more such materials can be used simultaneously to form the starting fibrous layer for the present process.

In accordance with the improvement of the process of the present invention, the starting fibrous layer should not be stretched as it is fed to the multi-needle stitching machine. overfeeding is preferred. Usually, an overfeed in the range of 2.5 to 50% is satisfactory. However, the most preferred percent overfeed of the starting fibrous layer is in the range of 10 to 35%.

Several types of known multi-needle stitching machines, such as "Mali" or "Liba" machines, which can be fed with a nonwoven fibrous starting layer and separate stitching yarns, are suitable for use in the process of the present invention. Machines having one or two needle bars are preferred. It is also preferred that the multi-needle stitching machine have means for (a) feeding the starting fibrous layer without stretching, (b) maintaining low tensions in elastic stitching yarns fed to the needles and (c) withdrawing the stitched fabric under low tension.

The process of the present invention can employ one or more stitching yarn systems, respectively fed to one or more needle bars. At least one of the yarn systems must be threaded with elastic yarns. The yarns form the spaced-apart rows of stitches in the produced stitchbonded fabric. The spacing between the rows of stitches of a given yarn, is the same as the needle spacing or "gage" of a needle bar, and can vary from one per 2 cm to 10 per cm. The preferred needle spacing is 2 to 8 per cm. Suitable elastic yarns are spandex elastomeric yarns (such as of Lycra®, made by E. I. du Pont de Nemours and Company), rubber, elastic yarns covered or wrapped with hard yarns (e.g., Lycra® covered with nylon), and the like.

The elastic yarn that is fed to the stitching needles of the stitchbonding machine, when in place in the stitchbonded fabric must be capable of an elastic stretch to at least two or three times its as-stitched length, in order to provide the desired elastic stretchability to the stitchbonded fabric. Thus, in accordance with the process of the invention, the elastic yarns have a residual elastic stretchability of at least 100%, preferably at least 150%, and most preferably at least 200%, when stitched in the fabric. To achieve such a high residual elastic stretch, the elastic yarns must have break elongations of at least 300%, preferably in the range of 400 to 700%, and must deployed under low tensions during stitchbonding. This is accomplished in the process of the present invention with stitchbonding machines equipped with accurate feed-yarn controls for each needle bar, and accurate speed and tension controls for feeding the starting fibrous layer and withdrawing the stitchbonded product. The starting fibrous layer preferably is overfed a small amount (e.g., 2.5 to 10%). When high MD stretch is desired in the final product, the starting layer is overfed more (e.g., 25 to 50%). Also, the stitched fabric product is preferably withdrawn from the machine under low tension to further avoid stretching of the elastic stitching yarns as they enter the machine.

The desired low tension conditions described in the preceding paragraph are achieved by feeding the elastic yarns at a low enough tension to assure that the elastic yarns have a "residual stretch", defined hereinafter of no less than 100% as the yarn arrives at the stitching needles. However, the tension should not be so low that the elastic yarn sags significantly in its advance from a supply package to the stitching needle. Sagging should be avoided in order to assure stitches are not lost but are securely inserted into the fibrous layer. A companion non-elastic (or "hard") yarn, fed with the elastic yarn itself (e.g., an elastic yarn covered with a hard yarn) or as a hard yarn from a secondary yarn system, can also improve stitching continuity and facilitate the use of very low tensions in the elastic feed yarns. A secondary hard yarn system also helps prevent unraveling. The secondary hard yarn also assists in pulling the fibrous layer through the stitchbonding machine without putting excessive elongation into the elastic feed yarns. The use of secondary yarns is illustrated in the Samples 1, 2, 3 and 6 of the Examples below.

A wide variety of conventional warp-knitting stitches can be employed in accordance with the process of the present invention to stitchbond the fibrous layer with the elastic yarns or the secondary hard yarns. The elastic yarns can also be laid-in in a wide variety of ways. The examples below illustrate several preferred repeating stitch patterns for the yarns. Conventional numerical designations are used for the stitch patterns formed by each needle bar.

In the preceding description and in the Examples below, several parameters are mentioned, such as stretch, residual stretch, area stretch and break elongation. These and other reported parameters were measured by the following methods.

The percent residual stretch, %RS, remaining in elastic stitching yarn fed to the needles of the stitchbonder, was determined as follows. Once steady conditions were established in a stitchbonding test, the machine was stopped. A 25-cm length of stitching yarn was cut from the yarn just upstream of the point where it entered the guide of a stitching needle. The cut length was allowed to relax for 30 seconds, during which time, it retracts to its relaxed length, Lr, which was then measured in centimeters. The percent elongation at break of the elastic yarn, $E_b$, also was determined (e.g., by conventional techniques such as ASTM D 2731-72 for elastic yarns, or as reported by the manufacturer). Then, the percent initial stretch, "$S_i$", in the elastic feed yarn just upstream of the needle-bar guide, was calculated by the formula $$S_i = 100[(25/L_r) - 1].$$

The percent residual stretch was then calculated by the formula $$\%RS = 100[(E_b/S_i) - 1].$$

The stretch characteristics of the stitchbonded fabrics produced by the process of the invention were determined by the methods described in this paragraph. In measuring these characteristics, two sets of samples, each measuring 25-cm long by 5-cm wide were cut from the stitched fabric removed from the wound-up product roll of the stitching machine. One set of samples was cut in the direction parallel to the stitch rows (i.e., in the MD) and the other set transverse thereto (i.e., in the TD, that is, perpendicular to the stitch rows). Each sample was subjected to a stretching test, in which: (a) a 2-kg weight was suspended from the sample and the stretched length of the sample was measured; (b) the weight was removed from the sample, the sample was allowed to relax and contract for 10 seconds, and the contracted length was measured; and (c) steps (a) and (b) were repeated another four times. The five measurements of extended length were averaged and the five measurements of the contracted length were averaged. The percent stretch and contraction were calculated as by the formulae:

$Sm$ = as-stitched MD stretch ratio = $L_x/L_o$ $C_m$ = as-stitched MD contraction ratio = $L_c/L_o$ $S_t$ = as-stitched TD stretch ratio = $W_x/W_o$ $C_t$ = as-stitched TD contraction ratio = $W_c/W_o$ $A_s$ = as-stitched area stretch ratio = $S_m S_t$ $A_c$ = as-stitched area contraction ratio = $C_m C_t$ $LS$ = final over-all MD stretch ratio = $L_x/L_c$ $WS$ = final over-all TD stretch ratio = $W_x/W_c$ $AS$ = final over-all area stretch ratio = $A_s/A_c$ wherein $L_o$ = original length (MD as formed) = 25 $N_m$ $N_m$ = the number of elastic yarn stitches (or courses) inserted into fabric per cm of MD length $L_x$ = extended length of 2-kg-loaded MD sample $L_c$ = contracted length of unloaded MD sample $W_o$ = original width (TD as formed) = 25 $N_t$ $N_t$ = the number of elastic yarn stitches (or rows) inserted across the width (i.e., TD) of the fabric by the needle bar per cm of bar length (determined from the gage or number of filled needles per cm of bar length)

$W_x$ = extended length of 2-kg-loaded TD sample $W_c$ = contracted length of zero-loaded TD sample Another term used in the examples and calculated from the stretch characteristics determined by the above-described methods is "CF", the "cost factor". The cost of the stitchbonding operation mainly depends on the amount the stitched fabric contracts after it is stretched, as compared to its originally stitched area. Roughly, the cost varies inversely as $A_c$ (as defined above). "CF" is defined herein as the reciprocal of $A_c$.

EXAMPLES

The following examples illustrate processes of the invention with a Liba two-bar multi-needle stitching machine. The machine is operated with high residual stretch in the elastic stitching yarns fed to the needle bars, with overfed fibrous starting layers; and with low tension on the stitchbonded product that is wound up. In contrast, comparison processes are run with the same Liba machine without high residual stretch in the stitching yarns, without overfed fibrous starting layers and with high tension on exiting product.

In the examples and accompanying summary tables, samples made by processes of the invention are designated with Arabic numerals and Comparison Processes are designated with capital letters. Examples 1, 2 and 3 and Comparisons A and B illustrate processes for making TD-stretchable fabrics that have little or no elastic MD stretch. Examples 4, 5 and 6 and Comparisons C and D illustrate processes for making MD-stretchable fabrics that have limited TD stretch. Example 7 and Comparison E illustrate process processes for making fabrics that have high MD and high TD stretch.

The results show that processes of the invention produce stitchbonded fabrics having high elastic stretch at lower costs than can be produced by the comparison processes. Costs are inversely proportional the contraction ratio, $A_c$, that accompanies the stitchbonding operation.

In each of the examples, the two-bar Liba multi-needle stitching machine was fed with one of three types of fibrous starting layers. The layers are identified as follows:

W-1, a lightly bonded, 0.7-oz/yd$^2$ (23.8 g/m$^2$) carded web of 1.5-den (1.7 dtex), 1.5-inch (3.8-cm) long, polyester staple fibers (Type 54 Dacron® polyester, sold by E. I. du Pont de Nemours and Company), that was prepared on a Hergeth-Hollingsworth card and lightly bonded with a Kusters Bonder operating at 100 psi and 425° F. (689 kPa and 218° C.).

W-2, a lightly bonded, 0.9 oz-yd$^2$ (30.5 g/m$^2$) Reemay® Type 454 spunbonded polyester sheet of 1.8-den (2.0-dtex) continuous filaments (sold by E. I. du Pont de Nemours and Company in 1986, now obtainable from Reemay, Inc. of Old Hickory, Tenn.).

W-3, a lightly consolidated, 1.4 oz/yd$^2$ (47.5 g/m$^2$) sheet of Type-800 Tyvek® spunbonded olefin (sold by E. I. du Pont de Nemours and Company).

One of three types of elastic stitching yarns was supplied to one needle bar of the stitching machine and optionally, one of two types of substantially non-elastic stitching yarns was supplied to the other needle bar.

The needles were either (a) all fully threaded to form 12 stitches per inch (4.72/cm) or (b) every other needle was threaded to form 6 stitches per inch (2.36/cm). The elastic yarns are identified as follows:

E-1, a nylon-covered, 70-den (78 dtex), T-126 Lycra® spandex yarn (Type LO523 made by Macfield Texturing Inc. of Madison, N.C.), having a break elongation of about 380%. Lycra® is a spandex yarn made by E. I. du Pont de Nemours and Company.

E-2, the same as E-1 except that the nylon covering is absent (i.e., a bare, 70-den (78-dtex) T-126 Lycra® spandex yarn) having a break elongation of about 520%.

E-3, a 210-den (235-dtex) spandex yarn covered with a single wrap of 34-filament, 40-denier (44-dtex) 6—6 nylon, having a break elongation of about 380%.

The non-elastic yarns are identified as follows:

Y-1, a 150-den (167-dtex), 34-filament, Type-54 Dacron® polyester yarn (sold by E. I. du Pont de Nemours and Company).

Y-2, a texture version of Y-1 (Type 15034 yarn made by Unifi of Greensboro, N.C.).

The repeating stitch patterns formed by a bar, abbreviated "Pat" in Table I, are identified and described with conventional knitting-diagram nomenclature as follows:

P-1, a 1-0, 0-1 (pillar or open chain)

P-2, a 1-0, 1-2 (tricot)

P-3, a 0-0, 3-3 (laid in)

P-4, a 1-0, 1-2, 2-3, 2-1 (Atlas)

The details of the operation of the stitching machine operation for each example are summarized in Table I, below. The table lists the fibrous layer ("Web") and percent overfeed used, the stitching yarns employed on each bar and the repeating stitch pattern ("Pt") formed. Table I also lists "CPI", the number of stitches per inch, which corresponds to the number of courses per inch formed on the machine; "Gage", the number of stitching needles per inch filled by yarn on the stitching bar, which corresponds to the number of rows per inch formed on the machine; and "%RS", the residual stretch remaining in the elastic stitching yarn as it arrives at the needle (calculated as indicated hereinbefore).

Comparisons of the stretch characteristics of the fabrics of the Examples made in accordance with the invention versus and those made with the Comparison processes are summarized in Tables II, III and IV.

EXAMPLE 1

In this Example, a preferred process of the invention is used to prepare a stitchbonded fabric having high TD stretch (Sample 1). For comparison, a process outside the invention, similar to a known elastic yarn stitchbondig process, is used to make a fabric (Sample A), also having high TD stretch.

As shown above in Table I, the process of the invention and the comparison process each utilize an MD-oriented carded fibrous web W-1, a non-elastic stitching yarn Y-1 on the front bar of the stitching machine to form rows of pillar stitches of pattern P-1 and an elastic yarn E-1 on the back bar to form laid-in repeating pattern P-3. However, the processes for Sample 1 and Comparison Sample A differed in three important ways. In making Sample 1 in accordance with the invention (a) the elastic yarns were fed to the needles of the stitchbonding machine under very low tension, with a residual stretch of about 190%, (b) the fibrous layer was supplied with an overfeed of about 5 to 10% and (c) the stitchbonded fabric was removed from the stitchbonder with a tension of less than 2 lbs per linear inch (3.5 N/cm). In contrast, for Comparison Sample A (a) the elastic stitching yarns were fed taut with a residual stretch of only about 25%, (b) the fibrous layer was supplied with no overfeed and (c) stitched fabric was removed with a tension of about 15 pounds per linear inch (26.3 N/cm). Details of the process conditions and of the stretch properties of the resultant fabrics are respectively summarized in Table I (above) and Table II (below, immediately following Example 3).

In each of the resultant fabrics, the non-elastic stitches helped hold the laid-in elastic yarns in place in the fibrous web. The elastic yarns were oriented closer to the transverse direction (TD) than to the machine direction (MD). As a result, each of the stitched fabrics exhibited much stretch and contraction in the transverse direction and very little in the machine direction.

Immediately after stitching in accordance with the invention, Sample 1 could be TD-stretched by at least 80% ($S_t=1.80$) beyond its original as-stitched width without a substantial change in MD dimensions ($S_m=1.00$). Upon release from the TD-stretch, the Sample 1 elastically retracted to 60% of its stitchbonded width ($C_t=0.6$). After contraction, stitchbonded Sample 1 could be TD-stretched to about 300% of the contracted width, with an accompanying area stretch of about the same amount.

| | | | | Sample Preparation | | | | | | | | |
|---|---|---|---|---|---|---|---|---|---|---|---|---|
| | | | % | Stitching | | | | | | | | |
| | | | | | Front Bar | | | | Back Bar | | | |
| Ex. No. | Sample | Web | Overfeed | CPI | Yarn | Gage | % RS | Pat | Yarn | Gage | % RS | Pat |
| 1 | 1 | W-1 | 5-10 | 7 | Y-1 | 12 | * | P-1 | E-1 | 6 | 190 | P-3 |
| | A | W-1 | 0 | 7 | Y-1 | 12 | * | P-1 | E-1 | 6 | 25 | P-3 |
| 2 | 2 | W-1 | 5-10 | 7 | Y-2 | 12 | * | P-1 | E-2 | 6 | 280 | P-3 |
| 3 | 3 | W-2 | 5-10 | 7 | Y-2 | 12 | * | P-1 | E-1 | 6 | 210 | P-3 |
| | B | W-2 | 5-10 | 7 | Y-2 | 12 | * | P-1 | E-1 | 6 | 20 | P-3 |
| 4 | 4 | W-3 | 35 | 12 | E-1 | 6 | 170 | P-1 | ** | ** | ** | ** |
| | C | W-3 | 0 | 12 | E-1 | 6 | 30 | P-1 | ** | ** | ** | ** |
| 5 | 5 | W-2 | 30 | 12 | E-1 | 6 | 180 | P-1 | ** | ** | ** | ** |
| 6 | 6 | W-2 | 35 | 12 | E-3 | 6 | 180 | P-1 | Y-2 | 6 | * | P-4 |
| | D | W-2 | 25 | 12 | E-3 | 6 | 10 | P-1 | Y-2 | 6 | * | P-4 |
| 7 | 7 | W-2 | 25 | 12 | E-1 | 6 | 190 | P-2 | ** | ** | ** | ** |
| | E | W-2 | 0 | 12 | E-1 | 12 | 12 | P-2 | ** | ** | ** | ** |

*Yarns have almost no residual stretch.

**No second-bar yarn used in these tests.

As shown in Table II, in comparison to Sample 1, the as-stitched stretch ratio $S_t$ of Comparison Sample A was much smaller (1.10 versus 1.80) and the as-stitched contraction ratio $C_t$ also was much smaller (0.37 versus 0.60). Although both fabrics had about equal final overall area stretch ratios (AS of about 3), the cost factor associated with Comparison Sample A was 2.7 versus 1.7 for Sample 1. Thus, the of stitchbonding of Sample 1 would cost almost 60% more than the stitchbonding of Comparison Sample A.

EXAMPLE 2

To form Sample 2, which was made in accordance with a process of the invention, the stitchbonding of Sample 1 was repeated, except for the use of somewhat different stitching yarns. For Sample 2, a bare elastic spandex stitching yarn, having a residual stretch of about 280% and a textured non-elastic stitching yarn were employed (See Table I). The stretch ratios achieved by the Sample 2 are recorded in Table II. Even though the elastic yarn of Sample 2 was stitched with much larger residual stretch (RS=280% vs. 190%) than Sample 1, Sample 2 showed no substantial advantage over Sample 1, perhaps because of some uneven contraction of the fabric and some local yarn slippage. Each sample was made by a process of the invention and each had a much lower cost factor than Comparison Sample A.

EXAMPLE 3

This example illustrates the process of the invention for making of another stitchbonded fabric (Sample 3) that is highly TD-stretchable. In the example, a similar process outside the invention is used for making a comparison fabric (Sample B). As shown in Table I, each of Samples 3 and B was made with a lightly bonded, continuous polyester filament web and textured non-elastic yarns. The stitchbonding conditions for Sample 3 were substantially the same as used for Sample 1. Comparison Sample B was made in the same way as Sample 3, except that the residual stretch in the elastic stitching yarns, which was only 20% for Sample B versus 210% for Sample 3.

In addition to high TD-stretch, stitchbonded Sample 3 exhibited high strength and good resistance to unraveling. Samples 3 and B each possessed high final overall area stretch ratios (i.e., As=greater than 3) but Comparison B contracted much more than Sample 3, to 32% versus 54% of the original as-stitched area, (see Table II $C_t$ values). Accordingly, the cost factor CF for making Comparison Sample B is more than 50% greater than for making Sample 3 (i.e., CF=3.1 versus 1.9).

TABLE II

| Example No. | 1 | 1 | 2 | 3 | 3 |
|---|---|---|---|---|---|
| Sample | 1 | A | 2 | 3 | B |
| % Residual stretch | 190 | 25 | 280 | 210 | 20 |
| % web overfeed | 5–10 | 0 | 5–10 | 5–10 | 5–10 |
| N/cm exit tension | 3.5 | 26.3 | 3.5 | 3.5 | 3.5 |
| As-stitched ratio, $S_t$ | 1.80 | 1.10 | 1.90 | 1.85 | 1.00 |
| As-stitched ratio, $C_t$ | 0.60 | 0.37 | 0.60 | 0.54 | 0.32 |
| Final stretch ratio, AS | 3.00 | 2.97 | 3.17 | 3.42 | 3.12 |
| Cost factor, CF | 1.7 | 2.7 | 1.7 | 1.9 | 3.1 |

EXAMPLE 4

In this Example, MD-stretchable Sample 4 and Comparison Sample C were made only one needle bar of the stitching machine being used. No non-elastic yarn was employed. A 35% web overfeed was used for Sample 4, but Sample c was made with no overfeed of web. The stitching conditions are listed in Table I above. Elastic yarn E-1 was used to form a rows of pillar stitches in a lightly consolidated, spunbonded olefin sheet. The elastic stitching yarn for Sample 4 was fed with a residual stretch of 170% to a 6 gage threading of the needle bar and he spunbonded sheet was overfed 35%. For Comparison Sample C, the elastic yarn was fed with only 30% residual stretch, a 12-gage threading was used and the sheet was not overfed. Both processes produced final stitchbonded fabrics that were highly stretchable in the machine direction (i.e., AS was 3.25 for Sample 4 and 2.69 for Sample C). However, immediatley after stitching, Sample 4 exhibited considerable MD stretch, but Comparison Sample C stretched very little beyond its original stitched dimension (Sm=1.95 for Sample 4 versus 1.05 for Sample C). After the stretch Sample 4 contracted to 60% of its original as-stitched area and Sample C contracted to 39% of its stitched area. The cost factor CF was 53% higher for the process of Comparison Sample C than for Sample 4 (i.e., CF=2.6 versus 1.7 ). These results are summarized in Table III, below.

EXAMPLE 5

In this example, the procedure of the invention for making Sample 4 of Example 4 was repeated except that a lightly bonded spunbonded continuous polyester sheet (web W-2) replaced spunbonded olefin sheet (web W-3) and a web overfeed of 30% rather than 35% was used to make Sample 5. The advantageous resulting stretch and cost characteristics of Sample 5 are summarized in Table III, below.

EXAMPLE 6

In this example, Sample 6 which was made in accordance with the invention and Comparison Sample D which was made by a process outside the invention, were each prepared with (a) lightly bonded continuous polyester filament web W-2, fed with a high % overfeed, (b) high denier covered spandex elastic yarn E-3 threaded at 6 gage on the front bar forming pillar stitches P-1, (c) textured non-elastic yarn Y-6 threaded at 6 gage on the back bar and forming atlas stitches P-4 and (d) low tensions for withdrawing the stitched fabric from the machine. Beecause Sample 6 was stitched with elastic yarn having a 180% residual stretch while Sample D was stitched with elastic yarn having a residual stretch of only 10%, more advantageous stretch charcteristics and a much lower cost factor was obtained for Sample 6 than for Comparison Sample D. Detailed results are summarized in Table III.

TABLE III

| Example No. | 4 | 4 | 5 | 6 | 6 |
|---|---|---|---|---|---|
| Sample | 4 | C | 5 | 6 | D |
| % Residual stretch | 170 | 30 | 180 | 180 | 10 |
| % web overfeed | 35 | 0 | 30 | 35 | 25 |
| N/cm exit tension | 3.5 | 3.5 | 3.5 | 3.5 | 3.5 |
| As-stitched ratio, $S_m$ | 1.95 | 1.05 | 2.05 | 1.70 | 1.05 |
| As-stitched ratio, $C_m$ | 0.60 | 0.39 | 0.57 | 0.50 | 0.38 |
| Final stretch ratio, AS | 3.25 | 2.69 | 3.60 | 3.40 | 2.76 |
| Cost factor, CF | 1.7 | 2.6 | 1.8 | 2.0 | 2.6 |

EXAMPLE 7

This example illustrates the the preparation of a stitchbonded fabric having elastic stretch on both the MD and TD. Sample 7 is made by the process of the invention; the process for Comparison Sample E is outside the invention. Process details are given in Table I above. Only the front needle bar of the Stitchig machine was used. The processes for preparing both fabrics included feeding of lightly bonded continuous polyester filament web W-2 to the stitching machine, stitching a repeating tricot stitch pattern P-2 into the web with elastic yarn E-1 and then removing the stitched fabric with low tension. For Sample 7, the needle bar was 6 gage, with the elastic yrns hd a residual stretch of 190% and the web was overfed 25%. For Comparison Sample E, the needle bar ws 12-gage, the elastic yarns had only 12% residual stretch and the web was not overfed. The stretchabilities of both samples were determined separately in the MD and the TD. The results of these measurements are summarized in Table IV, which shows the much better stretch and cost characteristics of Sample 7 over Comparison Sample E. The very little residual stretch in the stitching yarns of Comparison Sample E apparently led to the very high contraction of the fabric as originally stitched (i.e., very low as-stitched contraction ratios $C_m$ and $C_t$) which, in turn cause the high cost factors.

TABLE IV (Example 7)

| Sample | 7 | E |
|---|---|---|
| % Residual stretch | 190 | 12 |
| % Web overfeed | 25 | 0 |
| MD-stretch properties | | |
| As-stitched ratio, $S_m$. | 1.90 | 1.05 |
| As-stitched ratio, $C_m$ | 0.48 | 0.32 |
| Final stretch ratio, AS | 3.65 | 3.28 |
| Cost factor, CF | 2.1 | 3.1 |
| TD-stretch properties | | |
| As-stitched ratio, $S_m$ | 1.40 | 1.20 |
| As-stitched ratio, $C_m$ | 0.61 | 0.40 |
| Final stretch ratio, AS | 3.93 | 3.00 |
| Cost factor, CF | 1.6 | 2.5 |

The final stretch ratios and cost factors recorded in Table IV are somewhat artificial for two-directional stretch fabrics. However, they do provide a strong indication of the relatively greater value as a two-way stretch fabric of Sample 7, made in acordance with the process of the invention, over Comparison Sample E.

The stretchability of the Sample 7 and Comparison Sample E were further evaluated for elastic two-way stretch (i.e., area stretch). A flat as-stitched sample of each fabric, as removed from the stitching machine, was mounted on a hoop of 8-inch (20.3-cm) diameter. A centrally located circle of 2-inch (5.1-cm) diameter was marked on mounted sample. The thusly marked sample was then stretched gently by hand over a sphere of 6-inch (15.2-cm) diameter. In so stretching, the marked circle of Sample 7 stretched to a 3.8-inch (9.7-cm) diameter, providing a stretched area that was 3.6 times the original as-stitched area. In contrast, by the same procedure, Comparison Sample E stretched to a diameter of only 2.3 inches (5.8 cm) or to an area of only 1.3 times the original as-stitched area. After releasing the fabric from the hoop, the "2-inch-diameter" circle contracted. For Sample 7, the contraction was to a diameter of about 1.5 inches (3.8 cm) or to about 56% of its as-stitched area. In contrast, for Comparison Sample E, the contraction was to a diameter of about 1.1 inches (2.8 cm) or to about 30% of it originally as-stitched area. The final total elastic stretchability of the fabric (i.e., the ratio of the stretched area compared to the contracted area) amounted to 6.4 (640%) for Sample 7 and only 4.4 (440%) for Comparison Sample E.

I claim:

1. An improved process for preparing an elastic stitchbonded fabric which comprises the steps of feeding to a stitchbonding operation a nonbonded or lightly bonded fibrous layer weighing in the range of 15 to 150 g/m$^2$, multi-needle stitching the layer with elastic thread that forms spaced-apart, parallel rows of stitches, the needle spacing being in the range of 0.5 to 10 needles per centimeter and the stitches within each row being inserted at a spacing in the range the range of 1 to 7 stitches per cm, and removing the fabric from the stitchbonding operation, the improvement comprising feeding the elastic yarns to the stitching needles with a residual stretch of at least 100%.

2. A process in accordance with claim 1 wherein the fibrous substrate is overfed to the stitching operation by an amount in the range of 5 to 75% and the resultant stitched fabric is withdrawn under a tension of no more than 9 Newtons per linear centimeter of fabric width and the residual stretch is at least 150%.

3. A process in accordance with claim 1 wherein the fibrous layer weighs in the range of 20 to 50 g/m$^2$, the fibrous substrate is overfed by an amount in the range of 10 to 35%, the needle spacing is 2 to 8 needles per cm, the residual tension in the elastic yarn is at least 200% and the tension on withdrawing product is less than 3.5 N/cm.

4. A mulit-needle stitched fabric produced by process in accordance with claim 1, 2 or 3 having a substantially fully recoverable stretch in at least one direction of at least 100 %.

5. A fabric in accordance with claim 4 wherein the recoverable stretch is at least 200%.

6. A fabric in accordance with claim 4 formed from a substantially nonbonded fibrous layer weighing 20 to 35 g/m$^2$ that was stitched with two needle bars, one bar having been threaded with an elastic yarn that was stitched with a residual stretch of at least 150% and formed a laid-in repeating stitch pattern, the other bar havig been threaded with a substantially non-elastic yarn which forms a repeating pattern of pillar stitches, and the stitched layer having been removed from the stitching operation under low tension.

* * * * *